United States Patent [19]

Wilson

[11] 4,158,414

[45] Jun. 19, 1979

[54] CRANE DEVICE

[76] Inventor: Ray Wilson, West Alexandria, Ohio 45381

[21] Appl. No.: 798,119

[22] Filed: May 18, 1977

Related U.S. Application Data

[63] Continuation-in-part of Ser. No. 559,383, Mar. 17, 1975, abandoned, which is a continuation-in-part of Ser. No. 374,924, Jun. 29, 1973, Pat. No. 3,887,080.

[51] Int. Cl.[2] ..... B66C 5/02

[52] U.S. Cl. ..... 212/14; 212/130

[58] Field of Search ..... 212/18–21, 212/10–14, 130, 131; 214/300, 313; 104/89, 94, 95, 106, 107

[56] References Cited

U.S. PATENT DOCUMENTS

| | | | |
|---|---|---|---|
| 673,622 | 5/1901 | Moore | 212/18 |
| 1,212,860 | 11/1917 | Wettengel | 212/14 |
| 1,558,746 | 10/1925 | Moore | 212/130 |
| 1,876,904 | 9/1932 | Francis | 104/94 |
| 2,224,906 | 12/1940 | Froula | 212/130 |
| 2,928,356 | 3/1960 | Tredwell | 104/89 |
| 3,043,408 | 7/1962 | Attwood | 104/89 |
| 3,478,907 | 11/1969 | Dechantsreiter | 214/313 |

FOREIGN PATENT DOCUMENTS

| | | | |
|---|---|---|---|
| 2438061 | 7/1974 | Fed. Rep. of Germany | 104/95 |

*Primary Examiner*—Lawrence J. Oresky
*Attorney, Agent, or Firm*—Walter Becker

[57] ABSTRACT

A crane device having a track supported main frame with a trolley rollable on the main frame at right angles to the direction of travel of the main frame and with a carriage rotatable on the trolley. The trolley may consist of a single load trolley or it may consist of a load trolley and a trolley for carrying an operator's cab with each of the trolleys being provided with a rotatable carriage. The load trolley is adapted, via cables connected to the carriage, to engage a load such as a ladle. The ladle has a stopper which can be retracted by remote control from the operator's cab and is, likewise, tiltable for discharging slag and residue therefrom.

22 Claims, 9 Drawing Figures

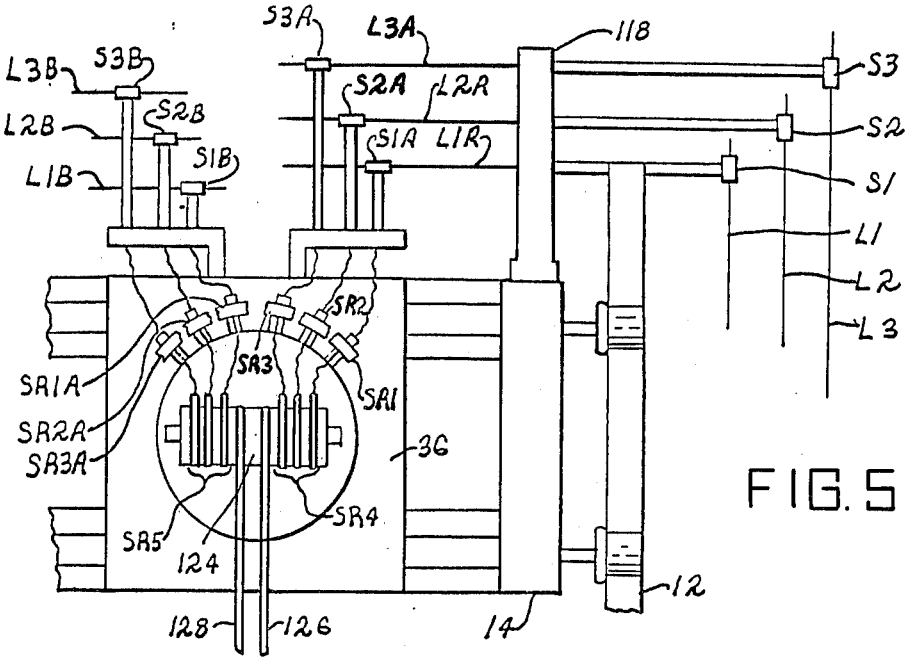
FIG. 5
FIG. 6
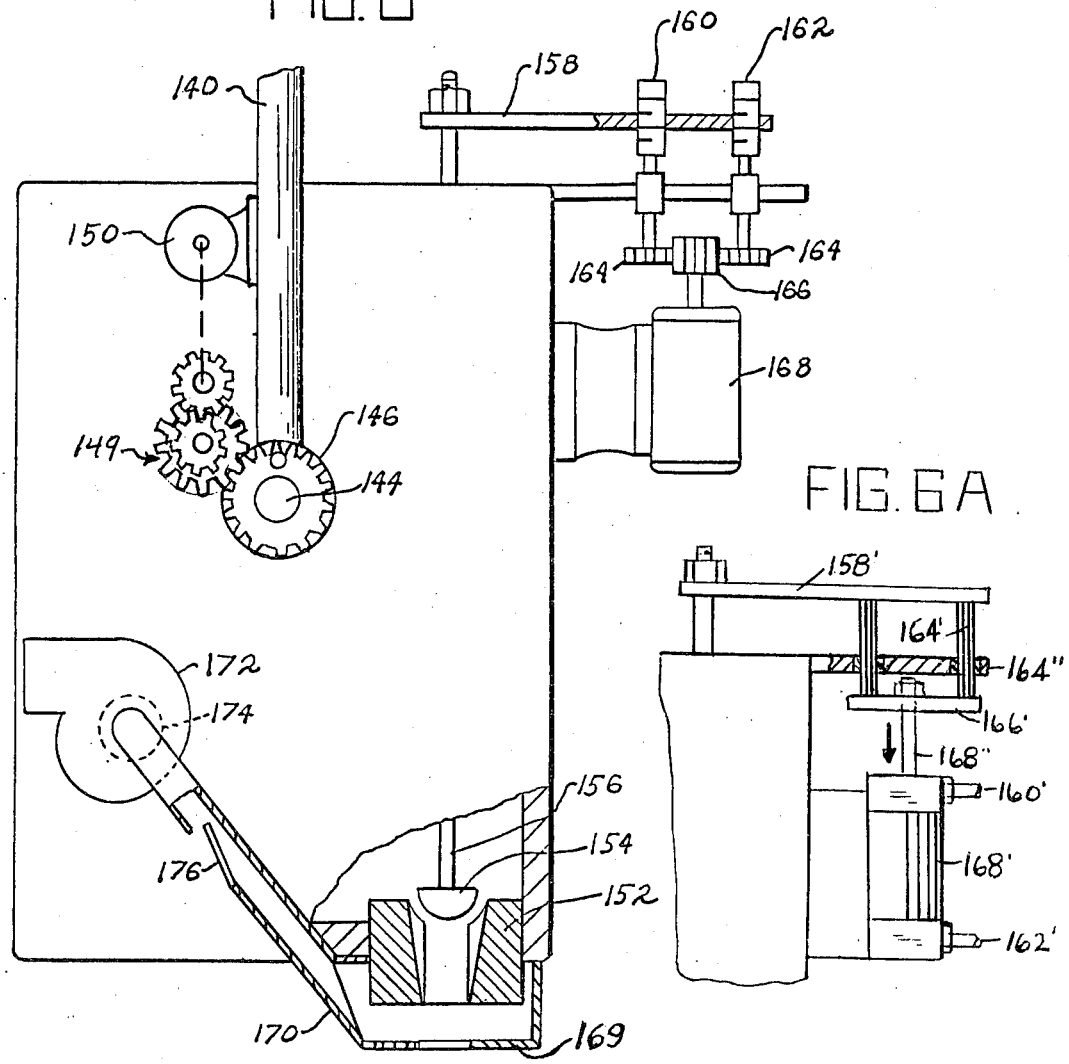
FIG. 6A

CRANE DEVICE

RELATED APPLICATIONS

This is a continuation-in-part of co-pending application Ser. No. 559,388—Wilson filed Mar. 17, 1975 now abandoned as a continuation-in-part of U.S. Ser. No. 374,924 filed June 29, 1973, entitled "Crane Structure", now U.S. Pat. No. 3,887,080—Wilson issued June 3, 1975.

The present invention relates to a crane device and is particularly concerned with a crane device which is more easy to manipulate than previous crane devices and which has greater strength and longer life than previous crane devices. The invention is also concerned with a novel ladle structure for use with the crane device.

The crane structure of my prior application shows a main crane frame movable in one direction and a trolley movable on the main frame at right angles to the direction of travel of the main frame and having a rotatable carriage thereon to which load cables are connected and which extend downwardly from the trolley to driven drums connected to a load platform.

The prior application also shows a similar trolley and carriage device with load cables leading downwardly from the carriage to driven drums mounted on top of an operator's cab. The operator's cab is provided with control switches and electric conductors are provided leading from a source of power to the operator's cab and then from the operator's cab to the various motors and also to a ladle carried by the load platform and having electrical and/or pneumatic controls thereon.

The present invention is concerned with a crane device or structure of the general nature referred to but constructed in a somewhat different manner and resulting in an extremely strong crane structure having long life and easily maneuverable during working operations.

BRIEF SUMMARY OF THE INVENTION

According to the present invention, stationarily mounted laterally spaced rails are provided and a main frame has rollers thereon engaging the aforementioned rails. One or more of the rollers on the main frame are reversibly driven for selective movement and positioning of the main frame along the stationary rails. The main frame according to the present invention comprises parallel H beams of substantial size interconnected at the opposite ends by suitable frame members so that the entire main frame makes a rigid assembly.

A trolley is rollingly supported for movement in the main frame in a direction perpendicular to the length of the stationary rails. The H beams of the main frame have upwardly opening channels on the tops of both of the webs providing tracks in which the rollers of the trolley run. There are two of the channels on top of the upper web of each H beam and two channels on top of the lower web of each H beam whereby the trolley has a plurality of supporting rollers engaging the channels for extremely solid support of the trolley on the main frame.

The rollers engaging the upper channels are driven and at least the two inner rollers engaging the lower channels are driven thereby greatly reducing the possibility of the rollers sliding or slipping when the trolley is driven in the main frame.

Rotatably supported on the trolley is a carriage and which carriage is provided with at least one driven drum to which load cables are attached and which extend downwardly from the drum for connection to a load, preferably, by a disengageable load hook arrangement.

In addition to the load trolley, there may be a further like trolley for supporting the operator's cab and which further trolley can, of course, be of lighter construction than the load trolley. A carriage is also rotatable in the further trolley and has driven drums therein to which cables are connected leading downwardly to the operator's cab.

The supply of power to the various power parts of the crane structure and the control of the parts is accomplished by sliding electrical connections and slip rings and control switches in the operator's cab.

The ladle adapted for being lifted by the load carriage has a vertically movable stopper for the pouring spout from the bottom thereof and which stopper may be electrically actuated between open and closed position by remote control from the operator's cab. Further, the ladle can be tilted by remote control from the operator's cab for discharging residue and slag therefrom.

Still further, the discharge opening of the ladle may be provided with a suction conduit leading to a fan so as to withdraw fumes and the like from the vicinity of the pouring spout.

The exact nature of the present invention as well as the objects and advantages referred to will become more apparent upon reference to the following detailed specification taken in connection with the accompanying drawings in which:

FIG. 5 is a schematic plan view showing the connections employed in connection with the device.

FIG. 6 is a side view of a ladle constructed according to the present invention.

FIG. 6A is a fragmentary view similar to that of FIG. 6 and showing a modification of mechanism in FIG. 6.

DETAILED DESCRIPTION OF THE INVENTION

Figure 1:
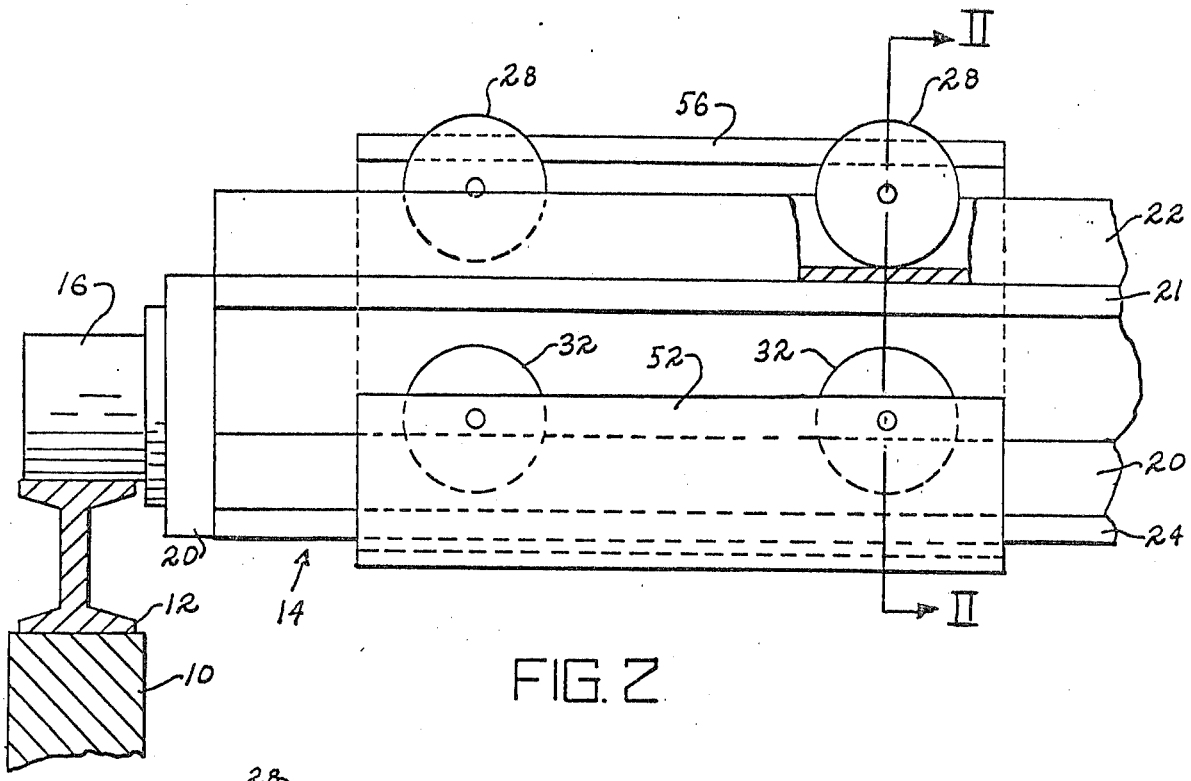
FIG. 1 is a fragmentary view of the crane device according to the present invention showing one of the stationary supporting rails and a portion of the main frame and a trolley rollable supported thereon.

Referring to the drawings somewhat more in detail, in FIG. 1, 10 indicates a stationary building member such as a wall and 12 indicates a rail stationarily mounted on top of wall 10. In practice, two of the walls 10 and rails 12 are provided in spaced parallel relation but only one is illustrated in FIG. 1. Extending between the rails is a main frame 14 having rollers 16 engaging the rails 12.

One or more of rollers 16 is driven by a motor arrangement not illustrated in the drawings for moving the main frame of the crane along the rails 12. The main frame 14 on the crane structure will be seen in FIGS. 1 and 2 to comprise a pair of spaced H members 18 interconnected at the opposite ends by fore and aft extending rigid structural members 20 and which latter members support the wheels 16.

Each H member 18 has an upper web 21 on which are mounted upwardly opening channels 22. Similarly, each H member has a lower web member 24 and mounted on the upper side thereof are further upwardly opening channels 26. Channels 22 and 26 extend longitudinally of the main frame substantially the full length thereof and are adapted for receiving the upper rollers 28 and 30 and the lower rollers 32 and 34 which form the supporting rollers for the trolley structure generally indicated by reference numeral 36.

The upper rollers 28 and 30 are mounted on a shaft 38 adapted for being driven by the electric motor 40 via gearing 42. The advantage of the present invention is that the wheels or rollers 28, 30 are flangeless as is clear in the drawing so that the crown of the wheel engages the u-shaped channel.

The lower rollers 34 are also mounted on a shaft 44 driven by another electric motor 46 via gearing 48.

Figure 2:
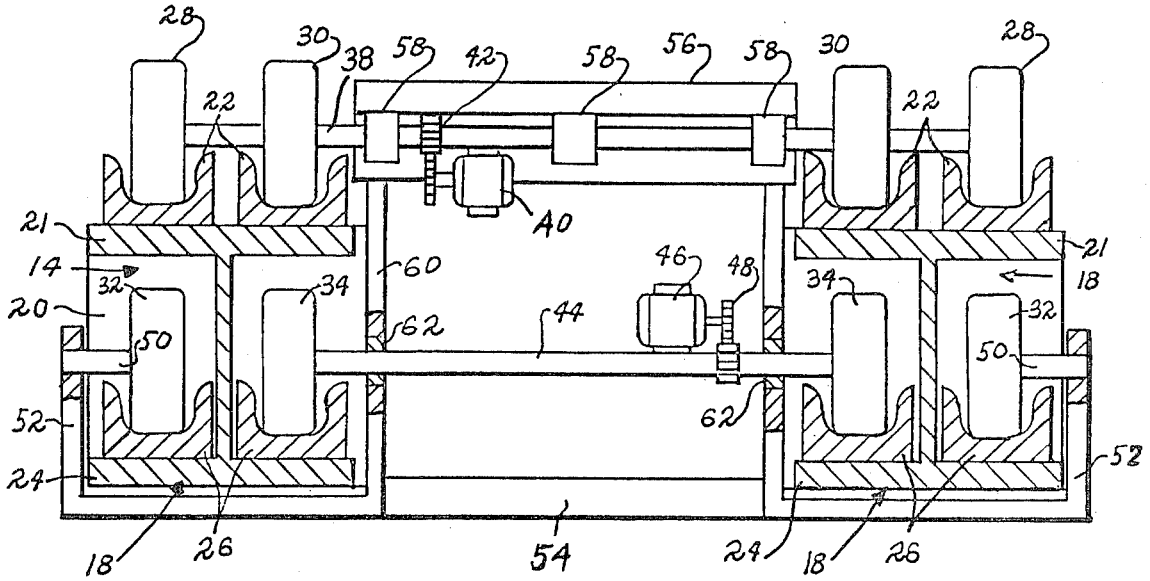
FIG. 2 is a sectional view indicated by line II—II on FIG. 1 showing more in detail the construction of the trolley and the manner in which it is supported on the main frame.

As will be seen in FIG. 1, there are at least two sets of the aforementioned rollers, one near each end of the trolley and the driving of the rollers at one end may be the same as that illustrated in FIG. 2.

The outer lower rollers, indicated at 32, are rotatable on shafts 50 which are fixed in the bracket members 52 which extend downwardly from shafts 50 then inwardly underneath the respective H members for connection with a lower plate 54 forming a part of the trolley structure.

Trolley structure also comprises an upper plate 56 to which the bearings 58 for shaft 38 are connected while vertical plates 60 are fixed to both of plates 54 and 56 and may support the bearing 62 for shaft 44. The trolley may comprise further reinforcing or strengthening plates as may be desired to impact the necessary load carrying capacity to the trolley.

Figure 3:
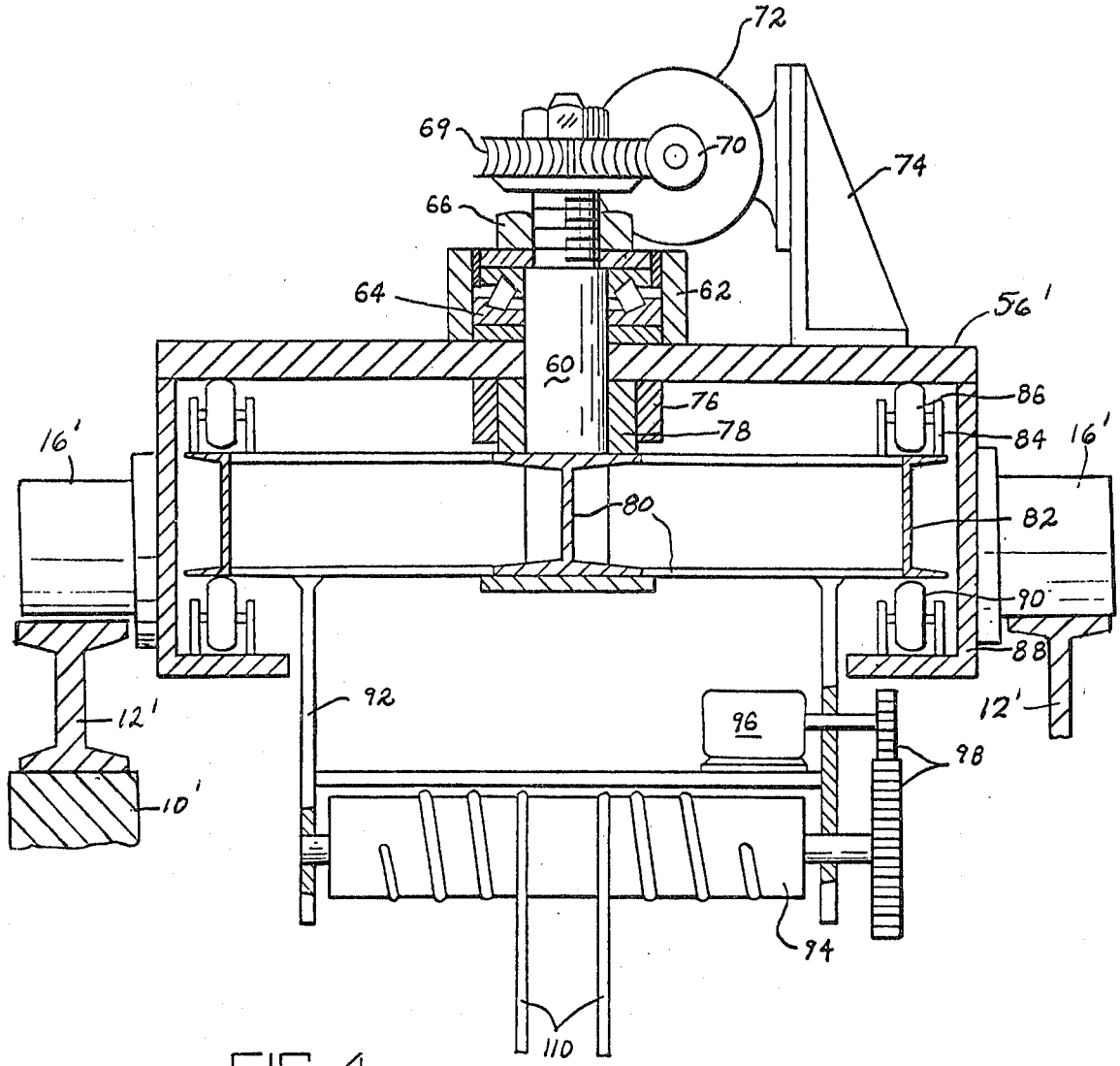
FIG. 3 is a vertical sectional view taken through the trolley showing one manner in which a carriage can be rotatably mounted thereon.

FIG. 3, which is a vertical section through at least a portion of the trolley, shows how one or the other of the plates 54, 56 in FIG. 2 of the trolley, in the case of FIG. 3, plate 56' may be provided with a bore through which a shaft 60 extends at a location clarified by represention of roller 16' on rail 12' of wall 10' using single primes with reference numerals for structure comparable with that of FIGS. 1 and 2. On top of plate 59, there is a ring 62 providing a recess for an antifriction axial thrust bearing 64. The bearing 64 is held in place by a nut 66 and on the outer end of shaft 60 is a worm wheel 69 engaged by a worm 70 driven by a motor 72 mounted on a support bracket 74 which is fixed to plate 56.

The plate 56 may have a ring or sleeve 76 fixed to the bottom thereof receiving a bearing bushing 78 in which shaft 60 is rotatable.

Beneath plate 56, shaft 60 has fixed thereto a spider structure which may consist of the radial I beam members 80 which, at the radially outer ends, are connected to channel means 82. Mounted on top of channel means 82, or on the upper sides of I beams 80 forming the spider, and in circumferentially distributed relation are brackets 84 carrying rollers 86 that engage the underside of plate 56.

Similarly, bracket means 88 dependent from plate 56 support rollers 90 engaging the under side of channel means 82. The aforementioned assembly of parts comprises a carriage rotatably supported on the trolley and guided by the bearings and rollers referred to so as not to tilt on the trolley. Dependent from the carriage and forming a part thereof are arms 92 between which is rotatably supported the cable drum 94 adapted for being driven by motor 96 via gearing 98. Load cables 110 are connected to the drum 94 and lead downwardly therefrom to a load engaging device and which may consist of a load hook.

Figure 4:
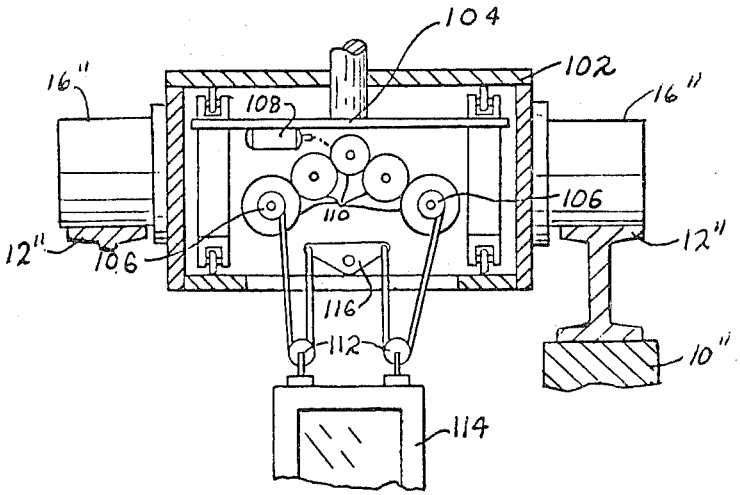
FIG. 4 is a view similar to FIG. 3 but showing how a trolley can be employed in respect of supporting the operator's cab.

In addition to the trolley and carriage just described, there may be a second trolley 102 movable along the main frame. This trolley 102 is illustrated in FIG. 4, but the rollers 16" by means of which it engages the main frame having a rail 12" on wall 10" are shown with double prime designation for structure comparable with that of FIGS. 1 and 2. Trolley 102 has a carriage 104 rotatable therein and which may be constructed the same as the trolley described in connection with FIG. 3 except that carriage 104 can be substantially lighter in construction.

Within carriage 104, there is rotatable a pair of load drums 106 and adapted for being driven by motor 108 via the gearing indicated at 110. Each drum may have two cables connected thereto and leading downwardly and around respective pulleys 112 on top of an operator's cab 114. The free ends of the cables lead upwardly from pulleys 112 and pairs of cables may be interconnected by means of a yoke 116 tiltable mounted in carriage 104.

FIG. 5 shows how sliders S1, S2 and S3 can be arranged to slide along power lines L1, L2 and L3 which are stationarily mounted adjacent the rail 12 along which the main frame 14 is movable. The sliders S1, S2 and S3 are carried by a bracket 118 mounted on the main frame. A second bracket at the opposite side of the main frame is provided and extending between the brackets and connected to the aforementioned sliders are lines **L1*a*, L2*a*, and L3*a*. The last mentioned wires are engaged by sliders S1*a*, S2*a*, and S3*a* carried by a bracket 120 mounted on the trolley 36**.

The trolley 36 also carries three superimposed slip rings SR1, SR2 and SR3 for rotation with the rotatable carriage 122 mounted in trolley 36. The aforementioned slip rings are of any desired size and are completely circular and are insulatingly supported and are electrically isolated from one another. Only fragments of the slip rings are shown in FIG. 5. Each slip ring is engaged by a respective brush which is connected with a respective one of the sliders **S1*a*, S2*a*, and S3*a***.

Wires lead from the aforementioned slip rings to the slip rings indicated at SR4 on a drum 124 rotatable on the carriage and within the drum the slip rings are connected to the wires contained within a cable 126 that leads from the drum to the operator's cab. Within the operator's cab, the wires are connected via switches and like control elements to further wires leading back up to the drum 124 by way of cable 128. For the sake of simplicity, it is considered that cable 128 contains only three wires, although it may contain many more, and these wires are connected inside the drum to a group of slip rings indicated at SR5 and which, in turn, are connected to a further group of slip rings as at **SR1*a*, SR2*a* and SR3*a*. These slip rings similarly to the first mentioned slip rings are mounted coaxially with the axis of rotation of carriage 122** and are supported in electrical isolation from each other and from the other slip rings. As before, only fragments of the last mentioned slip rings are illustrated. Each of the last mentioned slip rings is engaged by a brush which is connected with a respective slider S1*b*, S2*b* and S3*b* and which slide along further wires L1*b*, L2*b* and L3*b*.

It will be evident that the last mentioned wires that are under the control of switches in the operator's cab and can thereby be employed for controlling the supply of power to the various motors which drive the main frame and which drive the trolley on the main frame and which drive the carriage in rotation on each of the aforementioned trolleys. The electrical system can be extended in the manner illustrated to encompass as many control functions as may be desired including, of course, the raising and lowering of the operator's cab and the raising and lowering of the load.

FIG. 6 schematically illustrates the ladle according to the present invention. The ladle is carried by bail member 140 which is engageable by the load hook or is connected to a load platform pertaining to the load carriage. The ladle proper at 142 is tiltable on the bail about the axis 144. A gear 146 on the axis is connected to bail 140 and meshes with a gear means 149 driven by motor 150. By means of the gearing referred to, the ladle can be tilted about axis 144 to discharge residue and slag therefrom or it can be positioned in any desired tilted position. The gears 146, 149 form a gear reducer or gear ratio assembly mounted relative to the axle on a ladle in such a manner as to permit tilting as accomplished by mesh of the gearing in response to actuation of a gear driven tilt motor mounted on the bail of the ladle having a gear box mounted therewith.

The ladle has a discharge spout at 152 in the bottom adapted for being closed by a stopper 154 which is vertically movable between open and closed positions. At the upper end of rod 156 connected to stopper 154 there is an arm member or plate 158 which threadedly engages spindles or screws 160 and 162 which are rotatably supported laterally on the side of the ladle and which are adapted for being driven by respective gears 164 which mesh with a gear 166 rotatable by means of a motor 168.

The stopper can be opened or closed by control or motor 168 from the operator's cab by means of an extension of the electrical system illustrated in FIG. 5.

The ladle also comprises a hood or shroud 169 and duct arrangement 170 adjoining the discharge end of spout 152 for drawing fumes therefrom. Duct 170 leads to the inlet side of a blower or fan 172 mounted on the ladle and having a motor driven impeller 174 therein. For controlling the amount of suction exerted on the duct, the duct may have mounted therein a damper element 176 which may be moved automatically to control the applied suction or which may be adjusted manually if so desired.

FIG. 6A is a fragmentary view similar to FIG. 6 and schematically illustrates an arm member or plate 158' which is driven by rods or bars 164' interconnected by a cross member 166' movable by means of an actuator 168' with a cylinder and hydraulically shiftable by a rod 168'' piston therein; hydraullic lines 160' and 162' are connected to the actuator on either side of the piston in a well known manner for controlled supply and withdrawal of hydraulic fluid from a nonillustrated supply or source of fluid medium. The rods or bars 164' are guided in parallel by passages in a support 164'' for stability without any rotation of any shaft. The actuator or cylinder-piston means 168' transmits reciprocable movement for positively and accurately opening and closing a nozzle or opening with a stopper bead similar to that in the lower right corner of FIG. 6. This means the stopper rod can be raised and lowered without pivoting and also means less leakage from the stopper which can be opened and closed in a straight alignment with the nozzle.

Figure 7:
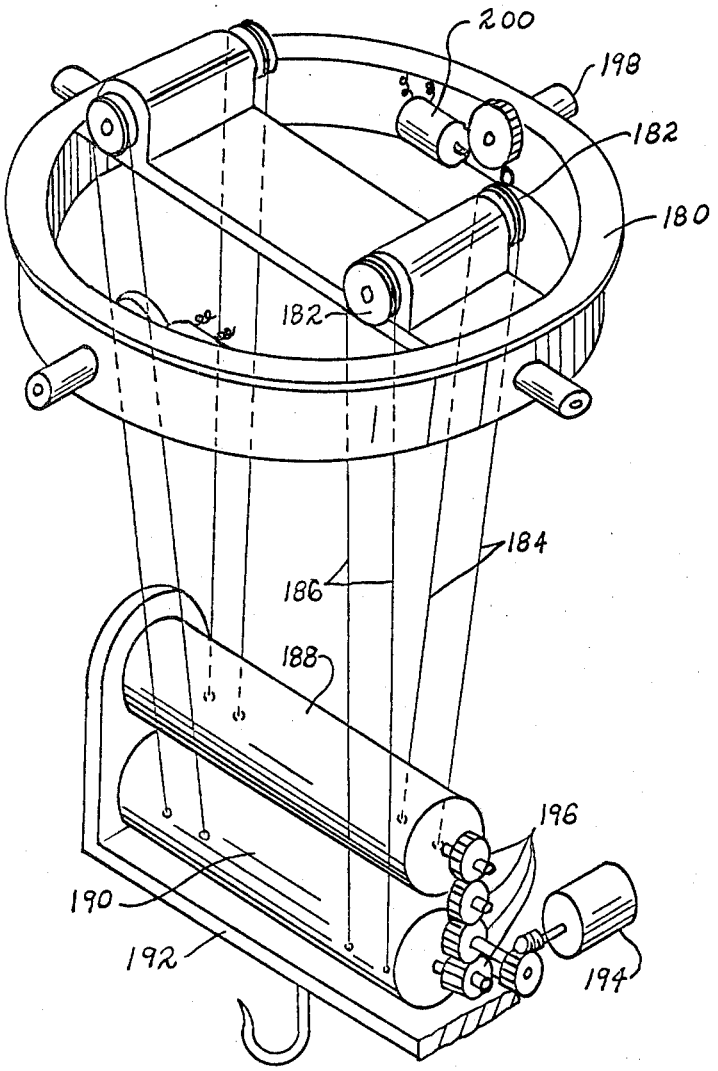
FIG. 7 is a perspective view showing an arrangement wherein the load drums are mounted on a load platform.

FIG. 7 shows a rotatable portion 180 of a load carriage having idler pulleys 182 therein over which cables 184 and 186 are entrained. These cables lead downwardly and are connected at the lower ends to respective load drums 188 and 190 carried in the load frame or plate 192 and adapted for being driven by motor 194 via gearing 196. FIG. 7 also shows that the carriage could be mounted in the trolley on rollers 198 with at least one thereof driven via motor 200 for rotating the carriage in the trolley while supporting the carriage without the use of a center post journalled in the trolley.

Figure 8:
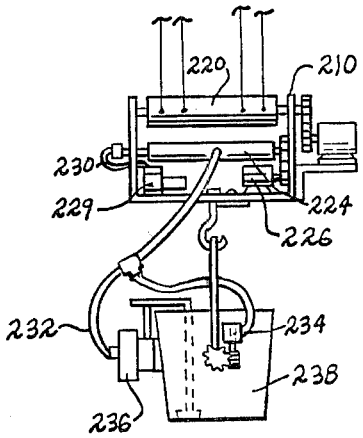
FIG. 8 is a schematic view showing a modification.

FIG. 8 is a fragmentary view showing a load frame 210 having a load drum 220 therein driven by a motor 222. The load frame, however, has a further and hollow drum 224 therein adapted for being driven by a motor 226. The load frame, furthermore, supports a compressor 229 connected by a conduit 230 with the inside of drum 224. Drum 224, in turn, has a service conduit 232 connected thereto and leading to fluid operable auxiliaries such as tilt motor 234 and stopper actuating motor 236 mounted on the ladle 238.

A dual wheel crane arrangement and complementary track are provided for the present invention. This means that the features of the present invention provide a longer lasting crane. In the past there has been alot of trouble with flat places occurring due to wearing on the crane wheels. Usually this is caused from overloading. When a crane wheel developes a flat place, the wheel must be replaced. The idea of the dual wheels results, in building a longer lasting wheel configuration which means that less reparis are encountered. The same is true for the dual crane track complementary to the dual wheel arrangement. The flat places wear on the track, and then the crane becomes hindered or gets stuck in the flat places and will not move properly. Thus, the track must be replaced. Therefore with the dual tracks, the cranes will last longer without repair and will carry a larger load. Also the channel direction decreases the amount of material with less repair. In the dual track the tracks last longer because there is more unlikely any occurrence of wear resulting in a flat in the same place. This represents a great improvement over any single track.

The dual wheel and track crane of the present invention permits distributing of a load, for example, of eight wheels on the top and eight wheels on the bottom, making a total of sixteen wheels that carry or support the load. Needless to say, less load per wheel is transmitted to the track as a result of the dual wheels used in accordance with the present invention.

The U.S. Pat. No. 3,478,907-Dechantsreiter provides a rigid crane for the purpose of operating a molten metal ladle which pours from the top. It is similar to a holding furnace since it is rigid and used only for raising and lowering with a dumping mechanism. This same method is used in a holding furnace. Neither Moore, Bevard, or Dechantsreiter have the means of rotating the trolley clockwise or counterclockwise and all lack the means of operating a bottom pouring ladle which is used for molten metal. The references show a means for only top pouring ladles and no means of rotating. The crane of the present invention provides, however, both methods for pouring from the bottom of the ladle or from the top of the ladle as well as means for rotating clockwise or counter-clockwise. This is a great improvement over all of the references noted. Furthermore the crane arrangement of the present invention is completely controlled from the crane cab by the crane operator.

U.S. Pat. No. 2,224,906—Fraula shows a top pouring ladle manually operated with a very limited movement of raising or lowering. The whole operation is limited. This type of pouring of molten metal is adapted for a monorail system. It is strictly a top pouring system with electrical power usually being supplied by suitable attachment to the monorail.

The improvements of the present invention are far greater because there are provided means making possible a bottom pouring system which is operated electrically by opening and closing the stopper to start and stop the flow of molten metal.

Threaded rods 160 and 162 are shown in the drawings, and these are used to raise plate 158 which is connected to the upper end of the stopper rod that also extends to the bottom outlet of the ladle to start and stop the flow of molten metal without any pivoting of the stopper rod. This means that the stopper plate can be raised and/or lowered without pivoting or binding being encountered. In the past, stopper arms were designed with one rod to bring about raising and lowering to allow the stopper arm to pivot the rod. When the rod pivots, the rod throws the stopper off in the bottom of the ladle and allows the molten metal to leak out of the ladle. This leaking of the ladle causes a lot of wasted metal and which is also very dangerous in numerous ways.

According to the present invention there is provided a suction fan or blower on the ladle with a vent control, whereby smoke is sucked away while the metal is being poured and this allows a better view for the operator. The present invention means whereby the operator can control the ladle operations from the crane cab. The electric power supply represents a far greater improvement clearly distinguishable from the cited references.

U.S. Pat. No. 1,290,212—Murray has also designed a top pouring ladle for molten metal which has the same limitations mentioned above.

The disclosure of Moore has a crane which could be used for carrying a ladle and also shows means for raising and lowering in a channel iron guide. However, Moore can only go so far downward as the guid extends. Therefore the operation of raising and lowering is very limited because if the guide extends too close to the floor, there would be danger of running the guide into objects on the floor. Consequently, the Moore disclosure has a bery limited means for raising and lowering. Also the means of electric operation of this crane of Moore is not shown. Therefore Moore shows no means of electrical control.

U.S. Pat. No. 1,212,860—Wettengel shows a ladle for pouring from the bottom. Also an electrically operated stopper is shown without anything, however, to prevent the stopper from pivoting as with the present invention representing a great improvement. The present invention provides a better system for opening and closing the stopper and to prevent the molten metal from leaking. The present invention also provides means for electric control from the crane cab by the operator.

The plate 158 is connected to the stopper rod for the purpose of starting and stopping the flow of metal in the bottom of the ladle. The shroud means 169 is secured to the housing which holds the screw shaft bearings in the line with the stopper plate. The shroud means, the shaft and the bearings are held in alignment to connect to the stopper plate which is connected to the stopper rod. The stopper rod extends to the bottom of the ladle to start and stop the flow of the metal in the ladle.

Two standard H beams are mounted in spaced parallel horizontally extending relation with the webs vertical and the flanges horizontal. Upwardly opening channel members are mounted on the upper sides of the flanges with each flange carrying a channel member on each side of the web region of the H beam.

The channels receive rollers mounted on the opposite ends of a carriage structure with the lower one of the outer rollers being supportingly connected to the carriage by structure extending beneath the respective H beam. The H beams are open on the bottom throughout the lengths thereof so that the structure referred to extending underneath each H beam does not interfere with any other part of the structure.

The described arrangement provides for eight support rollers in each of two lateral planes of the carriage thus providing for a total of sixteen rollers where the rollers are paired as shown in FIG. 1. The sixteen rollers provide good rolling support for the carriage and are capable of withstanding extremely high loads without being deformed as has been brought out in the specification.

The carriage is substantially coextensive with the H beams in the vertical direction thus making the structure of the present invention as compact as possible and which consideration is extremely important.

None of the prior art shows the same compact structure or one constructed in the same manner.

The Moore patent, which appears to be a leading reference, depends on the supporting of the movable part of the crane on specially constructed box beams 2 by means of channel elements on the top thereof. The special box beams 2 are not the same as the present invention's H beams and there is no way in which four upwardly opening channels can be mounted at upper and lower locations on the box beams 2 of Moore to arrive at anything at all similar to what the applicant provides by his unique arrangement of conventional rolled members making up the track arrangement that receives the rollers of FIGS. 1 and 2.

No combination of Moore with Bevard et al nor any of the other references, such as Dechanstreiter, would provide any structural arrangement corresponding to the present invetion.

FIG. 6 clearly shows discharge spout 152 and clearly shows a shroud element adjacent the discharge spout and which, furthermore, clearly shows a blower 172 connected to draw gas from within the shroud thereby withdrawing smoke and fumes from around the pouring region.

It is, of course, to be understood that the present invention is, by no means, limited to the specific showing in the draw-ups but also comprises any modifications within the scope of the appended claims.

What is claimed is:

1. In combination with a crane structure; a main frame having a longitudinal dimension longer than lateral dimension thereof comprising spaced parallel and horizontal H beams rigidly interconnected at the ends and means supporting said main frame at the ends for movement in a first horizontal direction at right angles to the longitudinal dimension of said main frame, each said H beam having an upper and lower flange horizontal and a web vertical, each said H beam having two upper upwardly opening channel members substantially coextensive in the longitudinal direction with said upper flange, said two upper upwardly opening channel members each being fixed to the upper side of said upper flange and each lying above and on each side of the web, two lower upwardly channel members substantially coextensive in the longitudinal direction with said lower flange, said two lower upwardly opening members each fixed to the upper side of said lower flange and each lying on each side of the web, trolley means, upper support means comprising four wheels mounted on a first common shaft and each of said four wheels riding in its respective upper upwardly opening channel members on said H beams, and lower support means comprising:

(a) two inner wheels mounted on a second common shaft which ride in the respective innermost pair of the lower upwardly opening channel members on said H beams, and (b) two outermost wheels mounted on a frame portion of said trolley means and which outermost wheels ride in the respective outermost lower upwardly opening channel members of said H beams, said frame portion extending beneath and laterally outside of said main frame, said trolley means being connected to and supported by said upper and lower support means and said trolley means being substantially coextensive with said H beams in the vertical direction.

2. A crane structure according to claim 1 which includes carriage means movable on said trolley means.

3. A crane structure according to claim 2 in which said trolley means includes a trolley for supporting an operator's cab, a carriage rotatable in the trolley, a pair of drums rotatably supported in said carriage, cables connected to each drum and leading downwardly therefrom, an operator's cab beneath the trolley having idler pulleys on top, said cables being entrained about said idler pulleys and leading therefrom back up to said carriage.

4. A crane structure according to claim 2 in which said trolley means includes a trolley for supporting an operators cab, a carriage rotatable in the trolley, a pair of drums rotatably supported in said carriage, an operators cab beneath the carriage, idler pulleys on top of said cab, a pair of cables for each frum each having one end connected to the respective drum and leading from the drum downwardly and about respective ones of said pulleys and back up to said carriage and at the free ends connected to the carriage.

5. A crane structure according to claim 2 which includes load cable means connected to said carriage means and extending downwardly therefrom, a ladle having a support bail operatively engaged by said cable means, said support bail being pivotally connected to the side of said ladle, a gear means fixed to the bail coaxial with the pivot axis of the ladle on the bail, a gear rotatable on the ladle and meshing with the gear means, and a motor connected for driving the gear to tilt the ladle on the bail.

6. A crane structure according to claim 2 which includes load cable means connected to said carriage means and extending downwardly therefrom, a ladle having a support bail operatively engaged by said cable means, said ladle having a bottom discharge spout, a stopper in the ladle engageable with the spout from above, a rod connected to the stopper and extending upwardly in the ladle, a plate connected to the rod near the top of the ladle, a pair of screws rotatable on the ladle and threadedly engaging said plate, and a motor drivingly connected to said screws to actuate said plate and rod and stopper.

7. A crane structure according to claim 2 which includes load cable means connected to said carriage means and extending downwardly therefrom, a ladle having a support bail operatively engaged by said cable means, said support bail being pivotally connected to the side of said ladle, a worm wheel fixed to the bail coaxial with the pivot axis of the ladle on the bail, a gear rotatable on the ladle and meshing with the worm wheel, a motor connected for driving the gear to tilt the ladle on the bail, said ladle having a bottom discharge spout, a stopper in the ladle engageable with the spout from above, a rod connected to the stopper and extending upwardly in the ladle, a plate connected to the rod near the top of the ladle, a pair of screws rotatable on the ladle and threadedly engaging said plate, and a motor drivingly connected to said screws to actuate said plate and rod and stopper.

8. A crane structure according to claim 2 which includes load cable means connected to said carriage means and extending downwardly therefrom, a ladle having a support bail operatively engaged by said cable means, said ladle having a bottom discharge spout, a stopper in the ladle engageable with the spout from above, a rod connected to the stopper and extending upwardly in the ladle, a plate connected to the rod near the top of the ladle, a pair of screws rotatable on the ladle and threadedly engaging said plate, a motor drivingly connected to said screws to actuate said plate and rod and stopper, a shroud member on the ladle surrounding the discharge end of the spout in radially spaced relation thereto and having an opening for the free flow of molten metal from the spout, and a blower on the ladle connected to withdraw air from within the shroud member.

9. A crane structure according to claim 8 which includes a duct leading from the inlet side of said blower to said shroud member and having a damper therein moveable to control the suction developed in said shroud member by said blower.

10. A crane structure according to claim 2 which includes pulley means on said carriage means, cables leading downwardly from said pulley means, a load frame having a load hook on the bottom, a cable drum rotatable on said load frame and connected to said cables, a pressure drum rotatable in said load frame and means for supplying pressure fluid thereto, and hose means leading from said pressure drum for connection to components of a ladle carried by said hook.

11. A crane structure according to claim 10 in which said components include a bail engaged by the said hook and on which said ladle is tiltable and fluid operable motor means connected between the bail and the ladle operable for tilting said ladle on said bail to discharge unwanted material from the ladle.

12. A crane structure according to claim 2 which includes a load frame beneath said carriage means, a pair of drums in vertically spaced relation in said load frame, motor means for driving said drums in rotation, and a pair of cables connected to each drum and connected in load transmitting engagement to spaced points of said carriage means.

13. A crane structure according to claim 12 in which said carriage means has spaced bearing members therein, a shaft in each bearing member, and a cable engaging member on each end of each shaft for engagement with a respective cable.

14. A crane structure according to claim 13 in which the cables pertaining to each of said drums is connected to the cable engaging members on the corresponding ends of said shafts.

15. A crane structure according to claim 2 which includes load cable means connected to said carriage means and extending downwardly therefrom, a ladle having a support bail operatively engaged by said cable means, said ladle having a bottom discharge spout, a stopper in the ladle engageable with the spout from above, a rod connected to the stopper and extending upwardly in the ladle, a plate connected to the rod neard the top of the ladle, a pair of parallel bars laterally on the ladle and engaging said plate, and motor means drivingly connected to said bars to actuate said plate and rod and stopper.

16. A crane structure according to claim 15 wherein said motor means is a hydraulic actuator having a piston rod reciprocably projecting therefrom and operatively connected to said bars.

17. A crane structure according to claim 16 wherein a cross member interconnects the piston rod with said bars.

18. A crane structure according to claim 1 in which said trolley means includes at least one trolley comprising a horizontal plate, a carriage beneath said plate, support means connected to the plate and extending to beneath the trolley, journal means rotatably supporting the trolley on the plate, and guide rollers interposed between said trolley and plate and between said trolley and said support means to support said trolley against tilting movements relative to said plate.

19. A crane structure according to claim 18 in which said journal means includes a shaft fixed to said carriage and extending upwardly therefrom, bearing means on said plate rotatably supporting said shaft, and means on the plate for driving said shaft to rotate the carriage on the trolley.

20. A crane structure according to claim 18 which includes at least one load drum mounted on said carriage and having load cable means connected thereto and leading downwardly therefrom, and means for driving said drum in rotation to pay out and reel in said cable means.

21. A crane structure according to claim 1 motors mounted on said trolley drivingly connected to the said first and second common shafts.

22. A crane structure in combination according to claim 1 which includes load cable means connected to said trolley means and extending downwardly therefrom, a ladle having a support bail operatively engaged by said cable means, said ladle having a bottom discharge spout, a stopper in the ladle engageable with the spout from above, a rod connected to the stopper and extending upwardly in the ladle, a plate connected to the rod near the top of the ladle, a pair of screws rotatable on the ladle and threadedly engaging said plate, a motor drivingly connected to said screws to actuate said plate and rod and stopper, a shroud member on the ladle surrounding the discharge end of the spout in radially spaced relation thereto and having an opening for the free flow of molten metal from the spout, and a blower on the ladle connected to withdraw air from within the shroud member.

* * * * *